United States Patent [19]

Iwata

[11] 4,394,963

[45] Jul. 26, 1983

[54] FUEL INJECTION NOZZLE

[75] Inventor: Masatoshi Iwata, Oyama, Japan

[73] Assignee: Kabushiki Kaisha Komatsu Seisakusho, Tokyo, Japan

[21] Appl. No.: 299,129

[22] Filed: Sep. 3, 1981

[30] Foreign Application Priority Data

Sep. 4, 1980 [JP] Japan ..... 55-125045[U]

[51] Int. Cl.[3] ..... F02M 61/08

[52] U.S. Cl. ..... 239/89; 123/531; 239/91; 239/409

[58] Field of Search ..... 239/87–89, 239/91, 93–95, 407–411, 533.2–533.12; 123/531–533, 294

[56] References Cited

U.S. PATENT DOCUMENTS

| | | | |
|---|---|---|---|
| 894,978 | 8/1908 | Peache | 239/88 |
| 1,411,108 | 3/1922 | Kastler | 239/408 X |
| 1,798,349 | 3/1931 | Okochi | 239/93 |

*Primary Examiner*—Andres Kashnikow

*Attorney, Agent, or Firm*—Armstrong, Nikaido, Marmelstein & Kubovcik

[57] ABSTRACT

A nozzle is disclosed for the air injection of fuel into the combustion chamber of a diesel engine cylinder. The nozzle includes a piston reciprocably mounted in the nozzle body to define therein a premixing chamber to be placed in and out of communication with the combustion chamber via spray holes at the tip of the nozzle body. Slidably fitted at one end in an axial bore in the piston, a needle valve is sprung to normally close the spray holes with its other end. Toward the end of the compression stroke of the piston, the mixture of fuel and air trapped in the premixing chamber acts on the needle valve to cause same to open the spray holes against the bias of the spring and thus is injected into the combustion chamber. The spring serves to cause the needle valve to firmly close the spray holes immediately upon full injection of the fuel-air mixture.

6 Claims, 3 Drawing Figures

FUEL INJECTION NOZZLE

BACKGROUND OF THE INVENTION

This invention relates to a fuel injection nozzle for atomizing and spraying each metered charge of fuel, premixed with air, into the combustion chamber of a cylinder in an internal combustion engine such as, typically, a diesel engine.

Some early diesel engines employed an air-injection system, such that the fuel was atomized into the cylinder under air pressure. Although the system admittedly provided excellent smoke-free combustion, it required expensive and bulky multistage compressors and intercoolers for injection air. Consequently, with the advent of spray nozzles capable of sufficiently atomizing the fuel by use of fuel pressure alone, the solid or airless injection has become the generally accepted method of fuel injection in compression-ignition engines.

Recently, however, it is being contemplated to inject fuel into diesel engine cylinders at pressures in the order of 1000 kgf/cm$^2$, with a view to higher engine efficiency and minimal exhaustion of air pollutants. The usual airless injection method does not necessarily provide good combustion at such ultrahigh pressures.

SUMMARY OF THE INVENTION

The present invention aims at the provision of an improved fuel injection nozzle for the delivery of premixed fuel and air into the combustion chamber of an engine cylinder, so made that the fuel can be finely atomized and vaporized and intimately blended with air to provide optimum combustion. In attaining this objective, moreover, the invention seeks to eliminate the need for bulky and expensive equipment conventionally required for injection air. The invention also seeks to positively terminate the injection of each charge of fuel-air mixture and hence to avoid improper combustion due to prolonged injection.

The improved fuel injection nozzle according to this invention includes a piston reciprocably mounted in a nozzle body to define therein a premixing chamber which is to be placed in and out of communication with the combustion chamber of an engine cylinder via one or more spray holes in the nozzle body. Slidably fitted in a bore in the piston is a valve member having one end projecting outwardly therefrom for opening and closing the spray holes in the nozzle body. A spring acts between the piston and the valve member for normally causing the latter to close the spray holes.

When the piston is in its normal or first position, fuel and air are admitted into the premixing chamber through respective inlet ports in the nozzle body. The piston closes the inlet ports as it starts traveling from the first to a second position, thus subsequently compressing the fuel-air mixture trapped in the premixing chamber. As the piston further travels on its compression stroke, the compressed mixture in the premixing chamber acts on the valve member to move same against the force of the spring for opening the spray holes, so that the pressurized fuel-air mixture is injected into the combustion chamber, therein to be ignited by the compressed, high-temperature air.

Thus, as is apparent from the foregoing summary, the fuel and air are pressurized in the premixing chamber, preparatory to introduction into the combustion chamber. The fuel can therefore be finely atomized and intimately mingled with the air and can further be vaporized by the heat produced by the compressed air. Preferably, the spring acting on the valve member is a compression spring mounted in the piston bore. Since the compression spring is at maximum compression upon full injection of the fuel-air mixture into the combustion chamber, the valve can positively close the spray holes under the highest spring pressure. Such positive closure of the spray holes upon completion of the injection of each charge serves to prevent improper combustion due to a prolonged period of injection, especially during engine operation under light load.

The above and other objects, features and advantages of this invention and the manner of attaining them will become more apparent, and the invention itself will best be understood, from a study of the following description and appended claims, with reference had to the attached drawings.

DESCRIPTION OF THE PREFERRED EMBODIMENT

Figure 1:
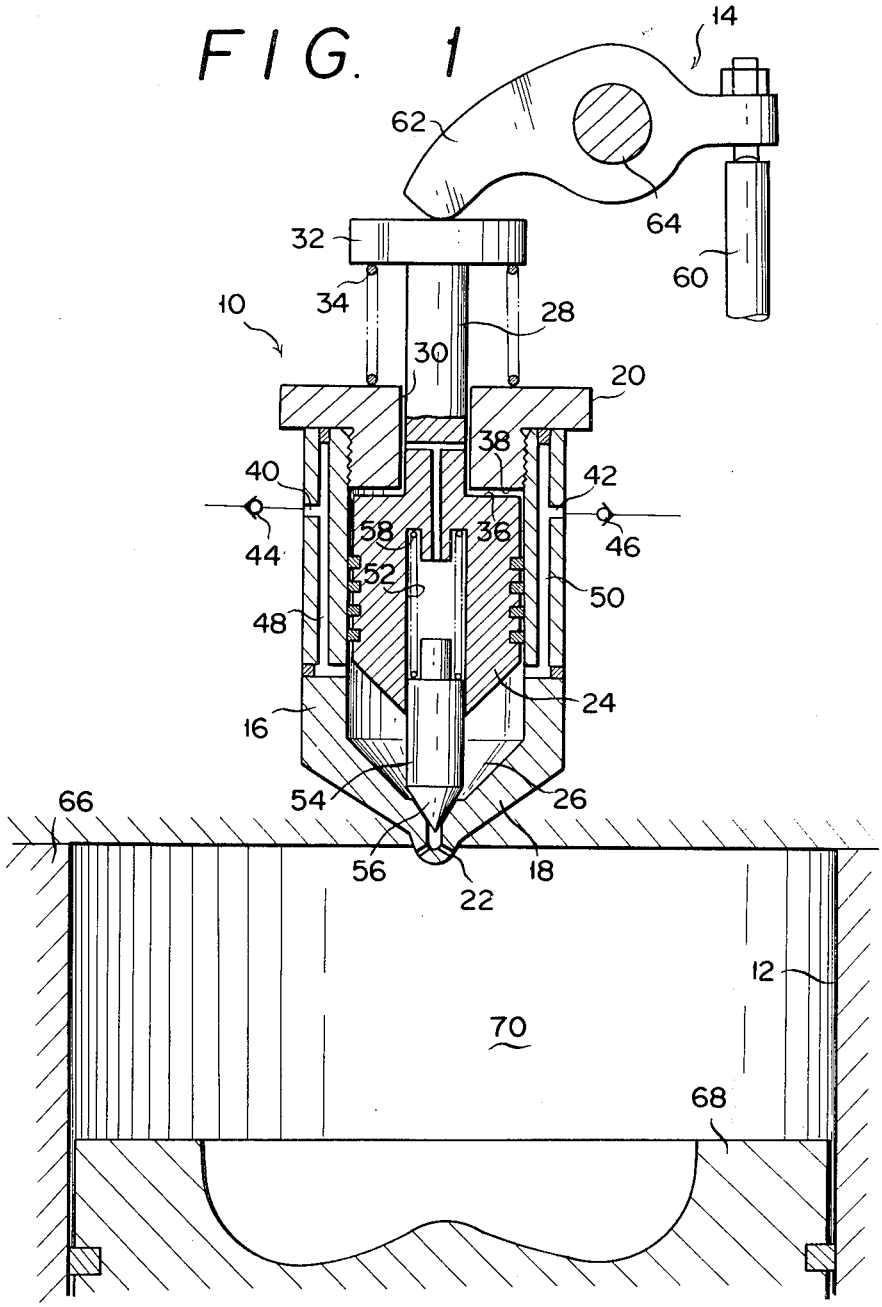
FIG. 1 is an axial sectional view, partly in elevation, of the fuel injection nozzle constructed in accordance with the present invention, shown together with its actuating mechanism and a diesel engine cylinder into which the premixed fuel and air is to be injected by the nozzle.
Figure 2:
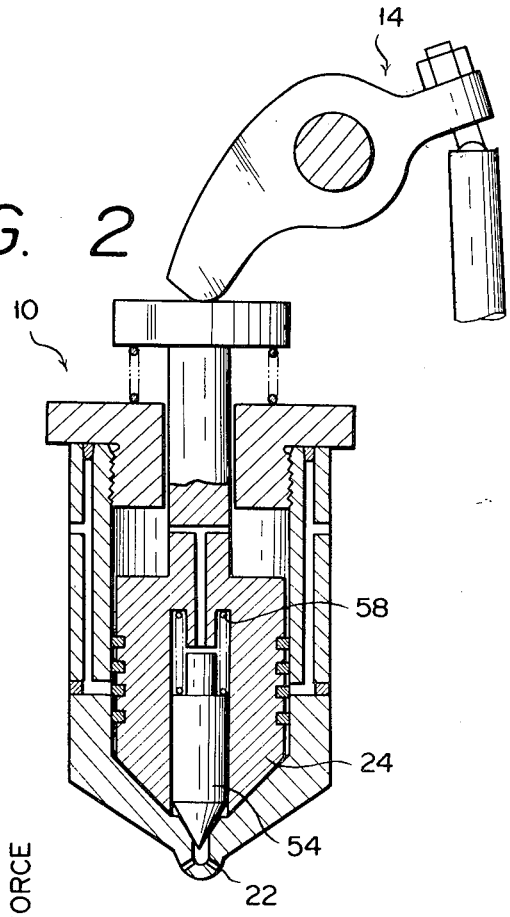
FIG. 2 is a view similar to FIG. 1 except that the nozzle is shown in a state at the end of injection.

FIGS. 1 and 2 show a preferred form of the fuel injection nozzle according to this invention, in different phases of operation. Generally designated 10, the nozzle is therein shown mounted in position on a diesel engine cylinder 12 and together with an actuating mechanism 14. The nozzle 10 comprises a body 16 of hollow cylindrical shape, having a conical tip 18 at its bottom end and open at its top, and a flanged cap 20 closing the open top of the nozzle body by making threaded engagement therewith. One or more spray holes 22 are formed centrally in the conical nozzle tip 18. Although the nozzle body 16 and the cap 20 form separate units to facilitate assemblage of the complete device, they may be considered integral for the purposes of the invention.

Slidably and pressure-tightly mounted in the nozzle body 16 for up-and-down reciprocation is a piston 24 defining in combination therewith a premixing chamber 26 for premixing and pressurizing fuel and air to be injected. The piston 24 is formed integral with a stem 28 extending upwardly therefrom and projecting out of the nozzle body through a bore 30 in the nozzle body cap 20. The stem 28 terminates in a flange 32 on its outer end. A helical compression spring 34 extends between the nozzle body cap 20 and the piston stem flange 32 for normally holding the piston 24 in a first or raised position shown in FIG. 1, in which the top 36 of the piston abuts against the bottom surface 38 of the cap.

The nozzle body 16 has formed therein a fuel inlet port 40 and an air inlet port 42 in communication with a suitable diesel fuel supply and a low-pressure air supply, both not shown, via check valves 44 and 46, respectively. The two ports 40 and 42 communicate with respective passageways 48 and 50 which are open to the premixing chamber 26 at points just below the piston 24 when same is in the raised position of FIG. 1. Thus, the premixing chamber 26 admits fuel and air when the piston 24 is raised, and the fuel-air mixture is trapped in this chamber immediately as the piston starts descending toward a second position seen in FIG. 2.

The piston 24 has a downwardly open bore 52 formed axially therein for slidably receiving one end of a needle valve 54. Projecting downwardly from the piston bore 52, the needle valve 54 has a conical tip 56 at the other end for opening and closing the spray holes 22 in the conical nozzle tip 18. A second compression spring 58 is housed in the piston bore 52 for biasing the needle valve 54 downwardly with respect to the piston 24, normally causing the needle valve to close the spray holes 22.

The actuating mechanism 14 comprises a pushrod 60 driven by the engine camshaft, not shown, and a rocker arm 62 coupled at one end to the pushrod and abutting at the other end against the piston stem flange 32. Pivotally supported at 64, the rocker arm 62 oscillates with the rectilinear reciprocation of the pushrod 60, depressing the piston 24 against the forces of the compression springs 34 and 58 with each pivotal motion in a counterclockwise direction.

Labeled 66 is the cylinder block of the diesel engine under consideration. The cylinder 12 formed in the cylinder block 66 has a piston 68 reciprocably mounted therein so as to define a combustion chamber 70. The spray holes 22 of the fuel injection nozzle 10 are open to this combustion chamber.

In operation, let it be assumed that the fuel injection nozzle 10 is now in the state of FIG. 1, with its piston 24 raised and its needle valve 54 lowered, and that the piston 68 in the engine cylinder 12 is lowered ready to start traveling upwardly on its compression stroke, also as depicted in FIG. 1. Since then the fuel inlet port 40 and the air inlet port 42 are both open to the premixing chamber 26, the fuel and air under low pressure are admitted into and stored in the premixing chamber, the spray holes 22 being closed by the needle valve 54. Toward the end of the compression stroke of the piston 68 in the engine cylinder 12 the actuating mechanism 14 acts on the piston stem flange 32 to depress the piston 24 against the forces of the compression springs 34 and 58. The piston closes the inlet ports 40 and 42 immediately as it starts traveling downwardly, so that the fuel and air trapped in the premixing chamber 26 are intimately intermingled and compressed.

As the downward stroke of the piston 24 proceeds, the degree of compression of the fuel-air mixture increases until at last, acting on the conical tip 56 of the needle valve 54, the compressed mixture causes upward displacement of the needle valve against the bias of the compression spring 58. With the spray holes 22 thus uncovered, the compressed fuel-air mixture is injected into the combustion chamber 70 of the engine cylinder 12, therein to be ignited by the air compressed to a high temperature.

In FIG. 2 is shown the fuel injection nozzle 10 with its piston 24 subsequently depressed to its lowermost position. In this second position the piston has expelled the complete charge of fuel-air mixture from the premixing chamber 26 into the combustion chamber 70, allowing the needle valve 54 to reclose the spray holes 22 under the bias of the compression spring 58. This spring is now at maximum compression, so that the needle valve can close the spray holes under the highest possible pressure, positively terminating the injection of the mixed air-fuel charge.

Figure 3:
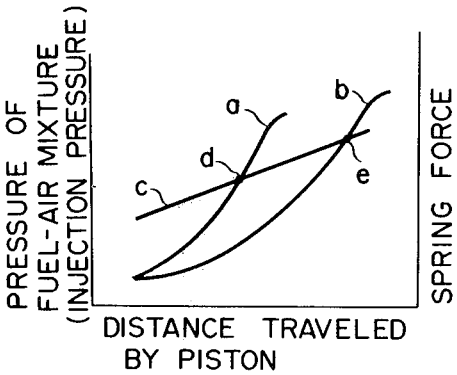
FIG. 3 is a graph explanatory of the performance of the fuel injection nozzle according to the invention.

In the graph of FIG. 3 the curves a and b plot the pressure of the fuel-air mixture in the premixing chamber 26 against the distance traversed by the piston 24 on its downward stroke when the fuel charge is large and small, respectively. The curve c plots the force of the compression spring 58 against the distance traversed by the piston. Thus the needle valve 54 opens the spray holes 22 at d and e. As will be understood from this graph, the force exerted by the compression spring 58 on the needle valve 54 to cause the latter to close the spray holes 22 is particularly high when the amount of the fuel injected is small, that is, when the engine is under light load. Such high valve-closing pressure serves to prevent poor combustion due to prolonged injection.

While the fuel injection nozzle according to this invention has been shown and described in terms of its preferred form, it is to be understood that changes and modifications may be made in the details of its construction and in its relations with the other parts of the engine in which it is incorporated, without departing from the spirit of the invention as expressed in the following claims.

What is claimed is:

1. A fuel injection nozzle for the delivery of fuel, premixed with air, to the combustion chamber of a cylinder in an internal combustion engine, comprising:

(a) a hollow nozzle body having formed therein at least one spray hole adapted to open to the combustion chamber of the engine cylinder;

(b) a piston slidably mounted in the nozzle body for reciprocating movement between a first and a second position and defining therein a premixing chamber to be placed in and out of communication with the combustion chamber of the engine cylinder via the spray hole, the piston having a bore formed axially therein;

(c) there being in the nozzle body a fuel inlet port and an air inlet port which are both open to the premixing chamber when the piston is in the first position and which are closed by the piston upon movement thereof from the first toward the second position;

(d) a valve member slidably fitted in the bore in the piston and having one end projecting outwardly therefrom for opening and closing the spray hole in the nozzle body; and (e) spring means acting between the piston and the valve member for normally causing the latter to close the spray hole in the nozzle body;

(f) the valve member being adapted to be acted upon, during the piston stroke from the first to the second position, by the compressed fuel-air mixture in the premixing chamber so as to move against the force of the spring means for opening the spray hole.

2. A fuel injection nozzle according to claim 1, wherein the spring means is a compression spring housed in the bore in the piston.

3. A fuel injection nozzle according to claim 1, wherein the valve member is a needle valve having a conical tip for opening and closing the spray hole in the nozzle body.

4. A fuel injection nozzle according to claim 1, further comprising second spring means for normally holding the piston in the first position.

5. A fuel injection nozzle according to claim 4, wherein the piston is formed integral with a stem slidably extending through and projecting out of one end of the nozzle body, the stem having a flange on its outer end, and wherein the second spring means is a compression spring extending between the flange of the stem and said one end of the nozzle body.

6. A fuel injection nozzle according to claim 5, in combination with an actuating mechanism acting on the flange of the stem for moving the piston from the first to the second position against the force of the second spring means.

* * * * *